US008341855B2

(12) United States Patent
Teteriatnikov

(10) Patent No.: US 8,341,855 B2
(45) **Date of Patent: *Jan. 1, 2013**

(54) SPINNING SHOE

(75) Inventor: Savva Teteriatnikov, Marina Del Rey, CA (US)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/075,075

(22) Filed: Mar. 29, 2011

(65) Prior Publication Data

US 2012/0227288 A1 Sep. 13, 2012

Related U.S. Application Data

(63) Continuation-in-part of application No. 13/042,327, filed on Mar. 7, 2011, now Pat. No. 8,104,193.

(51) Int. Cl.
*A43B 5/00* (2006.01)

(52) U.S. Cl. ..... 36/8.3; 36/136; 434/250

(58) Field of Classification Search ..... 36/115, 36/1, 136, 8.3; 434/250
See application file for complete search history.

(56) References Cited

U.S. PATENT DOCUMENTS

| | | | | |
|---|---|---|---|---|
| 1,649,294 | A | 11/1927 | Eichorn | |
| 1,868,765 | A | 7/1932 | Reynolds | |
| 2,109,712 | A | 3/1938 | Schmalz | |
| 2,168,303 | A | 8/1939 | Sothen | |
| 2,671,971 | A | 3/1954 | Garretson | |
| 3,081,562 | A * | 3/1963 | Oakley | 36/8.3 |
| 3,091,043 | A | 5/1963 | McCorkle | |
| 3,181,254 | A | 5/1965 | Cowen | |
| 3,204,348 | A | 9/1965 | Latson | |
| 3,354,561 | A | 11/1967 | Cameron | |
| 3,622,844 | A | 11/1971 | Barelli et al. | |
| 3,680,231 | A | 8/1972 | Dymond | |
| 3,707,047 | A | 12/1972 | Nedwick | |
| 3,739,497 | A | 6/1973 | Cameron | |
| 3,744,160 | A | 7/1973 | Dymond | |
| 3,757,437 | A | 9/1973 | Cameron | |
| 3,816,945 | A | 6/1974 | Egtvedt | |
| 3,824,710 | A | 7/1974 | Egtvedt | |
| 3,963,251 | A | 6/1976 | Miano | |
| 4,271,610 | A | 6/1981 | Parrent | |
| 5,199,192 | A | 4/1993 | Kilgore et al. | |
| 5,363,573 | A | 11/1994 | Kilgore et al. | |
| 5,566,478 | A * | 10/1996 | Forrester | 36/134 |
| 5,682,689 | A | 11/1997 | Walker et al. | |
| 5,692,323 | A * | 12/1997 | Goldberg | 36/134 |
| 6,035,559 | A * | 3/2000 | Freed et al. | 36/134 |
| 6,701,645 | B1 * | 3/2004 | Forrester | 36/134 |

(Continued)

FOREIGN PATENT DOCUMENTS

DE 3622844 A1 1/1988

(Continued)

*Primary Examiner* — Marie Patterson
(74) *Attorney, Agent, or Firm* — Kleinberg & Lerner, LLP; Marshall A. Lerner; Marvin H. Kleinberg

(57) ABSTRACT

A spinning shoe having an upper and sole member in which the sole member has a spinning assembly in the forefoot. The spinning assembly is placed within a recess in the forefoot region of the sole member. Thus, the user may walk about in the spinning shoe in a normal mode or spin about a vertical axis by placing the user's weight on the forefoot region and then spin about on the vertical axis.

25 Claims, 7 Drawing Sheets

U.S. PATENT DOCUMENTS

| | | | | |
|---|---|---|---|---|
| 6,829,848 | B2 | 12/2004 | Gallegos | |
| 7,757,413 | B2 | 7/2010 | Anderson | |
| 7,823,301 | B2 | 11/2010 | Belluto | |
| 2002/0088147 | A1 | 7/2002 | Joo et al. | |
| 2003/0056394 | A1* | 3/2003 | Yu | 36/8.3 |
| 2004/0123497 | A1* | 7/2004 | Tse | 36/115 |
| 2007/0051020 | A1 | 3/2007 | Tajima et al. | |
| 2007/0107268 | A1 | 5/2007 | Seeman et al. | |
| 2007/0240337 | A1 | 10/2007 | Belluto | |
| 2008/0022562 | A1 | 1/2008 | Manis | |
| 2009/0113761 | A1 | 5/2009 | Goldberg | |
| 2009/0165336 | A1 | 7/2009 | Anderson | |
| 2010/0186260 | A1 | 7/2010 | Colthurst | |

FOREIGN PATENT DOCUMENTS

| | | | |
|---|---|---|---|
| GB | 1385617 | A | 2/1975 |
| GB | 2221140 | A | 1/1990 |
| WO | 93/12682 | A1 | 7/1993 |

* cited by examiner

SPINNING SHOE

CROSS-REFERENCE TO RELATED APPLICATIONS

This application claims the benefit of priority based on, and is a continuation in part of U.S. application Ser. No. 13/042,327 filed on Mar. 7, 2011.

BACKGROUND OF THE INVENTION

1. Field of the Invention

The present invention relates to footwear and, in particular, a shoe that allows a user to spin about a vertical axis. The appearance is that of normal footwear because the spinning assembly is integrated in the sole member. The spinning assembly allows a user to spin or twist about in tight areas where one could only walk. The benefits are imparted from a new activity that employs a unique method of spinning.

2. Description of Related Art

Prior art shoes and equipment have attempted to provide means of rolling on surfaces in order to travel forward and backward. There have been no prior art shoes meant to spin about a vertical axis in order to allow the user to twirl or twist while wearing such shoes. Furthermore, prior art shoes have been quite large and unwieldy and their mechanisms were easily seen and not very discrete.

The present invention aims to provide a shoe that allows the user to spin about a vertical axis yet appear to still maintain the look of a conventional shoe.

BRIEF SUMMARY OF THE INVENTION

It is an object of the present invention to provide a spinning shoe that allows a user to spin about a vertical axis while maintaining the appearance of a conventional shoe.

The present invention is a spinning shoe comprising an upper, and a sole member. A sole member may be a unitary piece or a combined separate midsole and a separate outsole. In the preferred embodiment, the outsole is integrated with the midsole in order to create one unitary piece. The sole member contains a spinning assembly in the forefoot region. The forefoot region includes the region that extends substantially from the medial side to the lateral side at a location that begins in the vicinity of the front tip of the spinning shoe and extends from there to a location that is approximately one third of the distance toward the rear tip of the spinning shoe.

The spinning assembly is placed in a recess in the forefoot region of the sole member and comprises a retaining clip, a spinner housing, a washer, a spacer, a spinner lid, an axle and an outsole pad. These components, collectively referred to as the spinning assembly, form the mechanism that allows the user to spin. The components are discretely placed within a recess in the forefoot area of the spinning shoe, thus allowing the user to walk about and appear to wear a normal shoe. The spinning assembly fits flush within the recess so that only the outsole pad protrudes and is exposed to the ground.

The outsole pad on the spinning assembly allows the user to grip the ground on the forefoot and to spin about on a vertical axis. The outsole pad is an extension of the outsole, but placed on the spinning assembly. The outsole pad provides the same level of friction to the ground as the outsole, but since it is connected to the assembly, it may spin about when weight is placed on it.

The following is a description of the aforementioned components in the preferred embodiment from the orientation of the shoe in its normal unloaded position with respect to the ground. The direction of the description will be from the component closest to the ground up to the component closest to the user's foot. The outsole pad, as stated above, grips the ground and is affixed by an adhesive or other securing device or material to a spinner lid so that it may rotate in unison with the spinner lid. In between the outsole pad and spinner lid is an axle. The spinner lid contains a hole in its center. The axle generally has a tapered head so that it resembles a screw. The axle's head is positioned in between the outsole pad and through the hole in the spinner lid while the axle protrudes through the center of the spinner lid. On top of the spinner lid is a spacer. The spacer is flat ring with a circular opening in the center. The circular opening allows it to fit into a cavity of the spinner housing. The spacer may be made out of metal or another low friction material, such as Teflon®.

The spacer is placed on and held to the other components by friction. On top of the spacer is a suitable washer. The washer may be made out of metal or another low friction material, such as Teflon®. The washer has a circular opening in its center. The circular opening allows it to fit into a cavity of the spinner housing. The washer is placed on top of the spacer and held together by friction. All of the prior mentioned components are then placed in the spinner housing.

The spinner housing comprises a flange and three concentric cylindrical walls, with centers at the exact center of the spinner housing, with varying heights and thicknesses that form two separate cavities. The outer cylindrical wall is typically a thin, but tall wall. The middle cylindrical wall is typically a thin, but short wall. The inner cylindrical wall is generally shorter and thicker than the outer cylindrical wall and the middle cylindrical wall. The outer cylindrical wall and the middle cylindrical wall form a small cavity in which the spinner lid may rotate. The middle cylindrical wall and inner cylindrical wall create a cavity in which the spacer and washer may fit into and rotate. The axle is then placed through the center of the inner cylindrical wall and thus the center of the spinner housing. The axle extends through all of the prior mentioned components except for the outsole pad. At the top of the axle, a retaining clip is placed by friction in order to hold all the components together. The flange extends outwardly in a horizontal plane perpendicular to the cylindrical walls. The flange allows the spinning assembly to be placed stationary within the recess of the sole member and to also disperse the pressure and weight from the shoe onto the sole member.

In a preferred embodiment, a sole pad is placed on the top surface of the sole member at a location in the vicinity of the middle region of the sole member towards the toe region. The middle region includes the region that extends substantially from the medial side to the lateral side at a location that begins in the vicinity of the longitudinal center of the spinning shoe and encompasses an area that is approximately one third of the length of the spinning shoe. The sole pad overlaps a portion of the recess in which the spinning assembly is placed. The pad protects and cushions the user's foot from the rigidity of the spinning assembly and allows for a more smooth transition from the middle region to the toe region during walking, thereby increasing comfort. The sole pad may be constructed from ethylene-vinyl acetate, thermoplastic polyurethane or any other soft, resilient and flexible material.

In a preferred embodiment, the flange of the spinner housing contains multiple notches. The notches allow the spinner housing to line up during production as well as hold the spinner housing in place and prevent it from rotating.

Thus a user can rotate in a vertical axis by placing weight in the forefoot area. The weight of the users in the forefoot area thereby enables the user to rotate about such a vertical axis by placing the user's weight on the spinner assembly.

An advantage includes the ability to use the present invention to enjoyably obtain an exercise workout.

An aspect of this invention is the ability to walk about normally. A user may then spin about a vertical axis by simply transferring pressure and weight to the forefoot, specifically the outsole lid of the spinner assembly without having to touch any components. This invention allows the user to spin about, somewhat similar to a ballerina.

Another aspect of the invention is the ability to twist both legs about a vertical axis by just placing pressure on the forefoot of the shoe. This allows an individual to assume a motion akin to dancing or exercise.

Due to this new discrete assembly and the position of the spinning assembly, there is less wear on the shoes.

BRIEF DESCRIPTION OF THE SEVERAL VIEWS OF THE DRAWINGS

By way of example only, selected embodiments and aspects of the present invention are described below. Each such description refers to a particular figure ("FIG.") which shows the described matter. All such figures are shown in drawings that accompany this specification. Each such figure includes one or more reference numbers that identify one or more part(s) or element(s) of the invention.

DETAILED DESCRIPTION OF THE INVENTION

Figure 1:
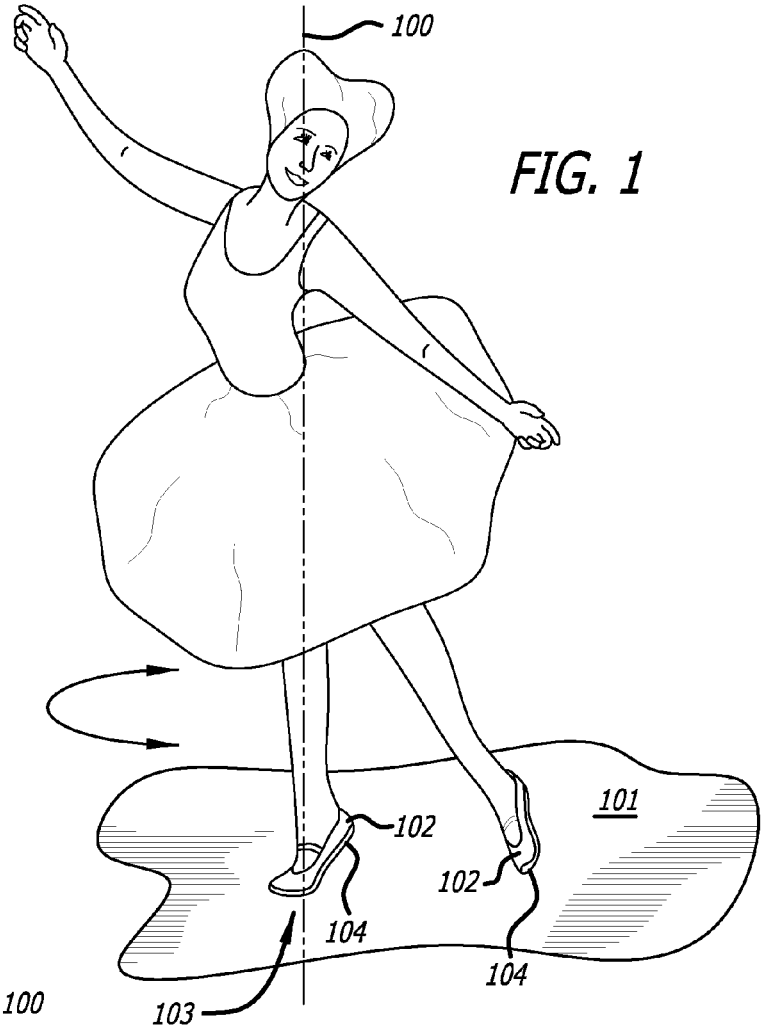
FIG. 1 is a perspective view that illustrates the use of the invention to rotate about a vertical axis.

The invention will now be described with reference to the perspective view shown in FIG. 1. This figure shows the user wearing an embodiment of the spinning shoe 103. The shoe has an upper 102 and a sole member 104. The user has their weight on their forefoot and is using the invention to spin around the vertical axis 100.

Figure 2:
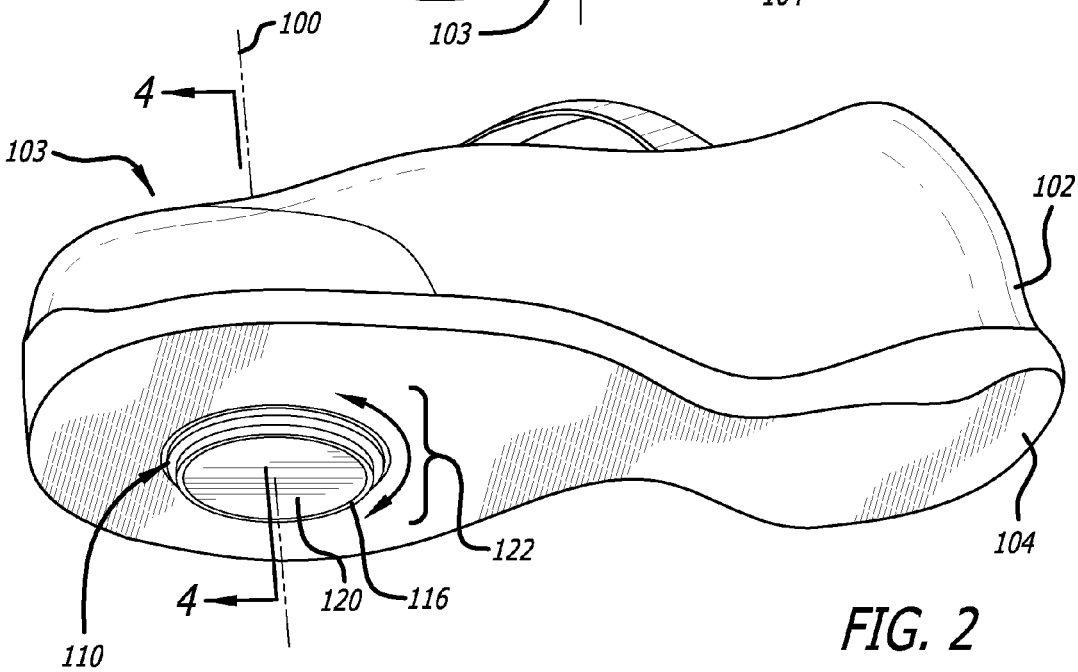
FIG. 2 is a perspective elevation view of an embodiment of the invention.

FIG. 2 is a perspective elevation view of an embodiment of the invention. FIG. 2 shows the placement of the spinning assembly 122 within the sole member 104. The outsole pad 120 faces the ground. The outsole pad 120 is affixed to the spinner lid 116 by an adhesive or other securing device or material. The outsole pad 120 rotates about the spinner housing 110, thus allowing either the outsole pad 120 or the spinning shoe 103 to rotate freely about vertical axis 100. Vertical axis 100 extends through the spinning assembly 122.

Figure 3:
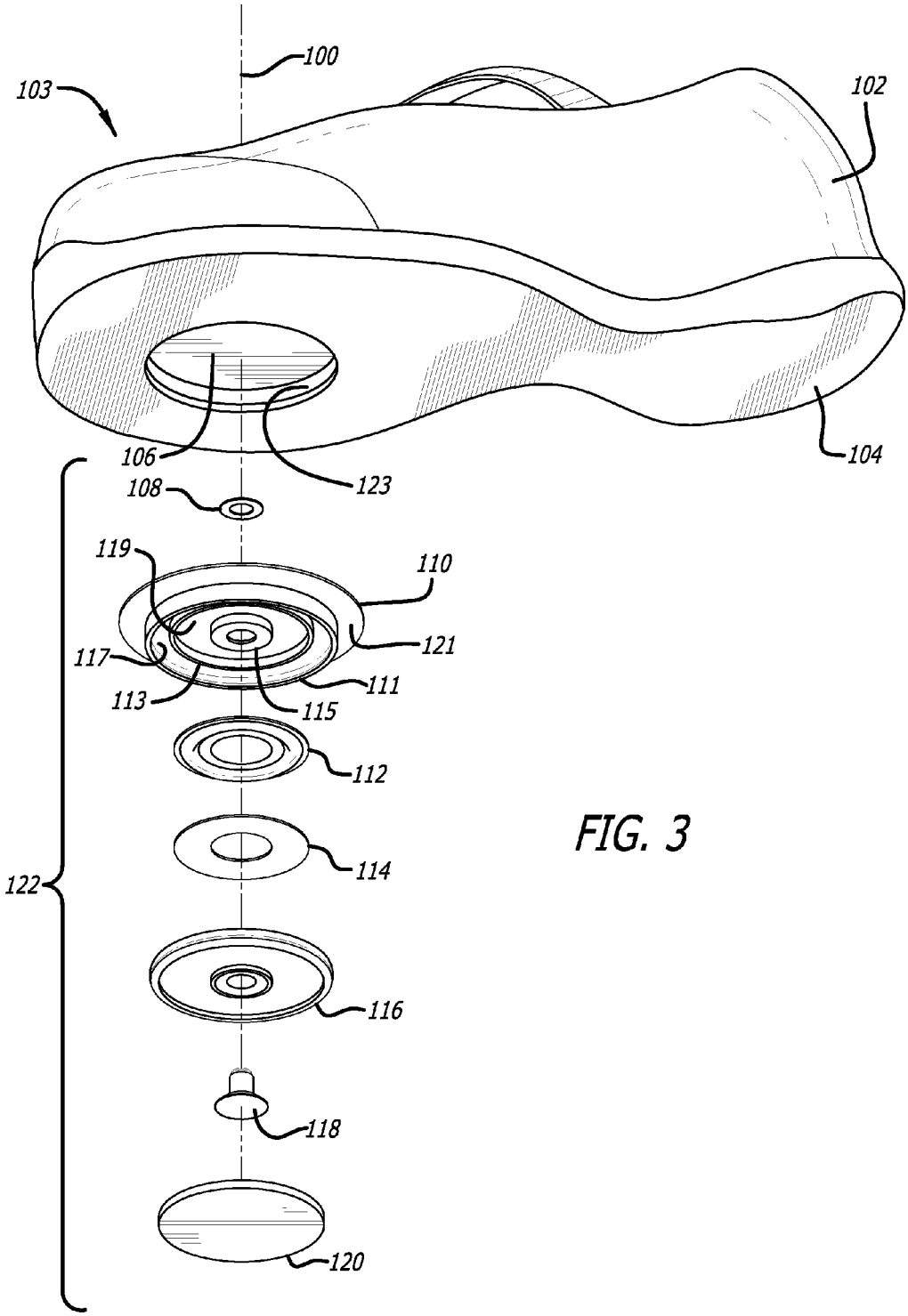
FIG. 3 is a perspective elevation view of an exploded embodiment of the invention.

FIG. 3 is a perspective elevation view of an exploded embodiment of the invention. The sole member 104 has a recess 106 in which the spinning assembly 122 is placed. The spinning assembly 122 is comprised of a retaining clip 108, spinner housing 110, washer 112, spacer 114, spinner lid 116, axle 118 and outsole pad 120. The outsole pad 120, as stated above, grips the ground 101 and is affixed by an adhesive or other securing device or material to a spinner lid 116. In a preferred embodiment, the outsole pad 120 is affixed to the spinner lid 116 so that it rotates in unison with the spinner lid 116. In between the outsole pad 120 and spinner lid 116, is an axle 118. The axle 118 generally has a tapered head. The axle's 118 head is placed in between the outsole pad 120 and spinner lid 116 while the axle 118 protrudes through the center of the spinner lid 116. The axle 118 may spin or be stationary with respect to spinner lid 116 and outsole pad 120, so that the spinner lid 116 and outsole pad rotate in unison. On top of the spinner lid 116 is a spacer 114, which may be made out of metal, aluminum or another low friction material, such as Teflon®. The spacer 114 is a flat ring with a circular opening in its center. The spacer 114 is maintained stationary with respect to the spinner lid 116 by friction so that it too rotates in unison with the spinner lid 116 and outsole pad 120.

Above the spacer 114 is a washer 112, which may be made out of metal, aluminum or another low friction material, such as Teflon®. In the preferred embodiment, the washer is a c washer. However, it may be any suitable washer. The washer 112 has a circular opening in its center. The washer 112 is placed on top of the spacer and is maintained stationary with respect to the other components by friction. All of the prior mentioned components are then placed in the spinner housing 110 to spin in unison.

The spinner housing 110 comprises a flange 121, three concentric cylindrical walls, with centers at the exact center of the spinner housing, with varying heights and thicknesses that form two separate cavities. The outer cylindrical wall 111 is typically a thin, but tall wall. The middle cylindrical 113 wall is typically a thin, short wall. The inner cylindrical 115 wall is generally shorter and thicker than the outer cylindrical wall 111 and the middle cylindrical wall 113. The outer cylindrical wall 111 and the middle cylindrical wall 113 form a first cavity 117 in which the spinner lid 116 is aligned. In the operation of the invention, the outer edge of the spinner lid 116 rotates in the cavity 117. The middle cylindrical wall 113 and inner cylindrical wall 115 create a second cavity 119 in which the spacer 114 and washer 112 may fit into and rotate. The axle 118 is placed through the center of the inner cylindrical wall 115 and thus the center of the spinner housing. The axle 118 extends through all of the previously mentioned components except for the outsole pad 120. A retaining clip 108 is placed at the top of the axle 118 and maintained by friction in order to secure all the components together. The flange 121 extends outwardly on a horizontal axis perpendicular to the cylindrical walls. The flange 121 fits within a specific extruded cavity 123 in the recess 106. The spinner housing 110 remains stationary with respect to the recess 106.

Figure 4:
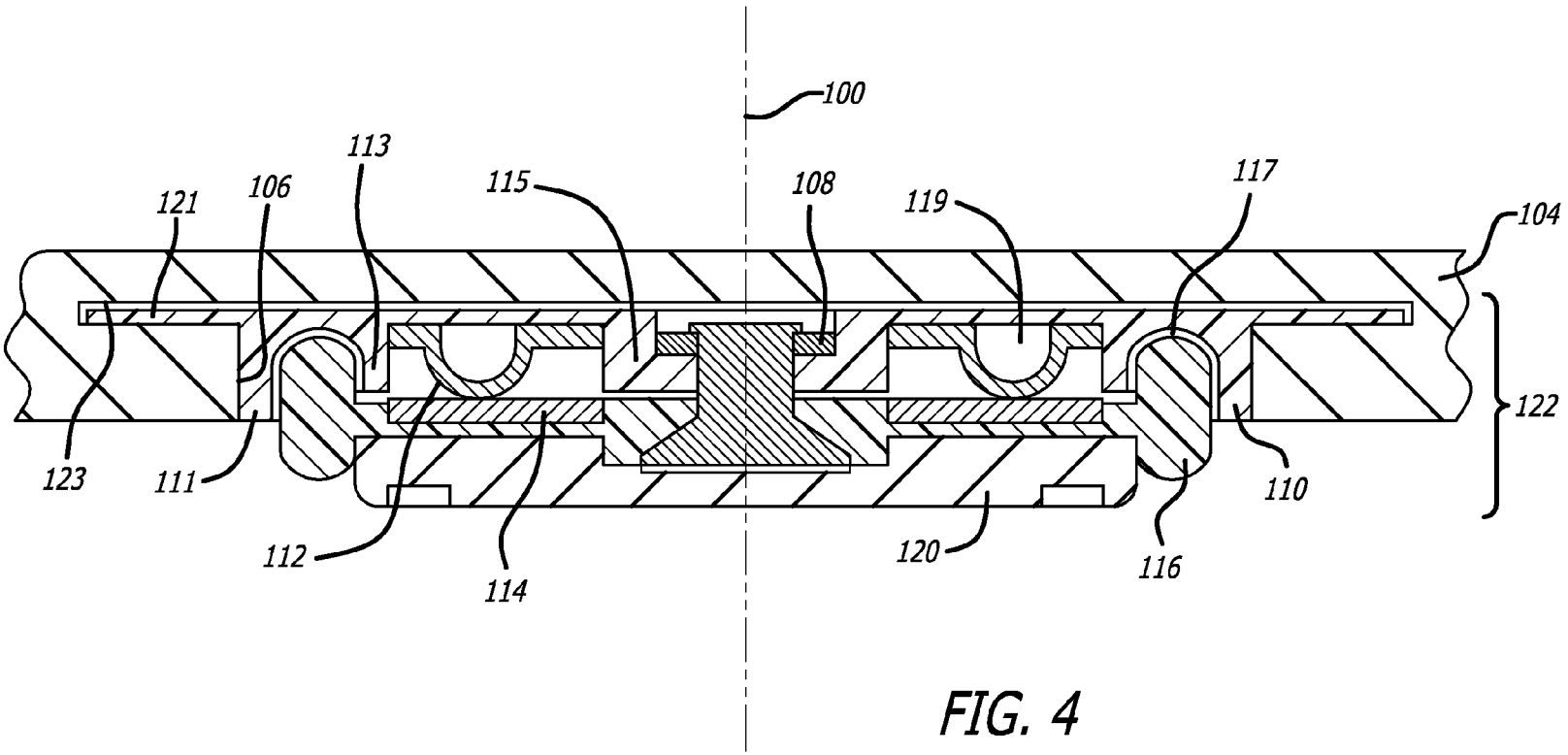
FIG. 4 is a side elevation view in cross-section of an embodiment of the spinning assembly.

A side elevation view in cross-section of an embodiment of the spinning assembly 122, inside the sole member 104 is shown in FIG. 4. FIG. 4 shows the proper placement and assembly of the individual components of spinning assembly 122 in the recess 106 of the forefoot area of the spinning shoe 103. The spinning assembly 122 allows both the combined outsole pad 120 and spinner lid 116 to rotate about a vertical axis 100 or for the sole member 104 to rotate about a vertical axis 100.

Figure 5:
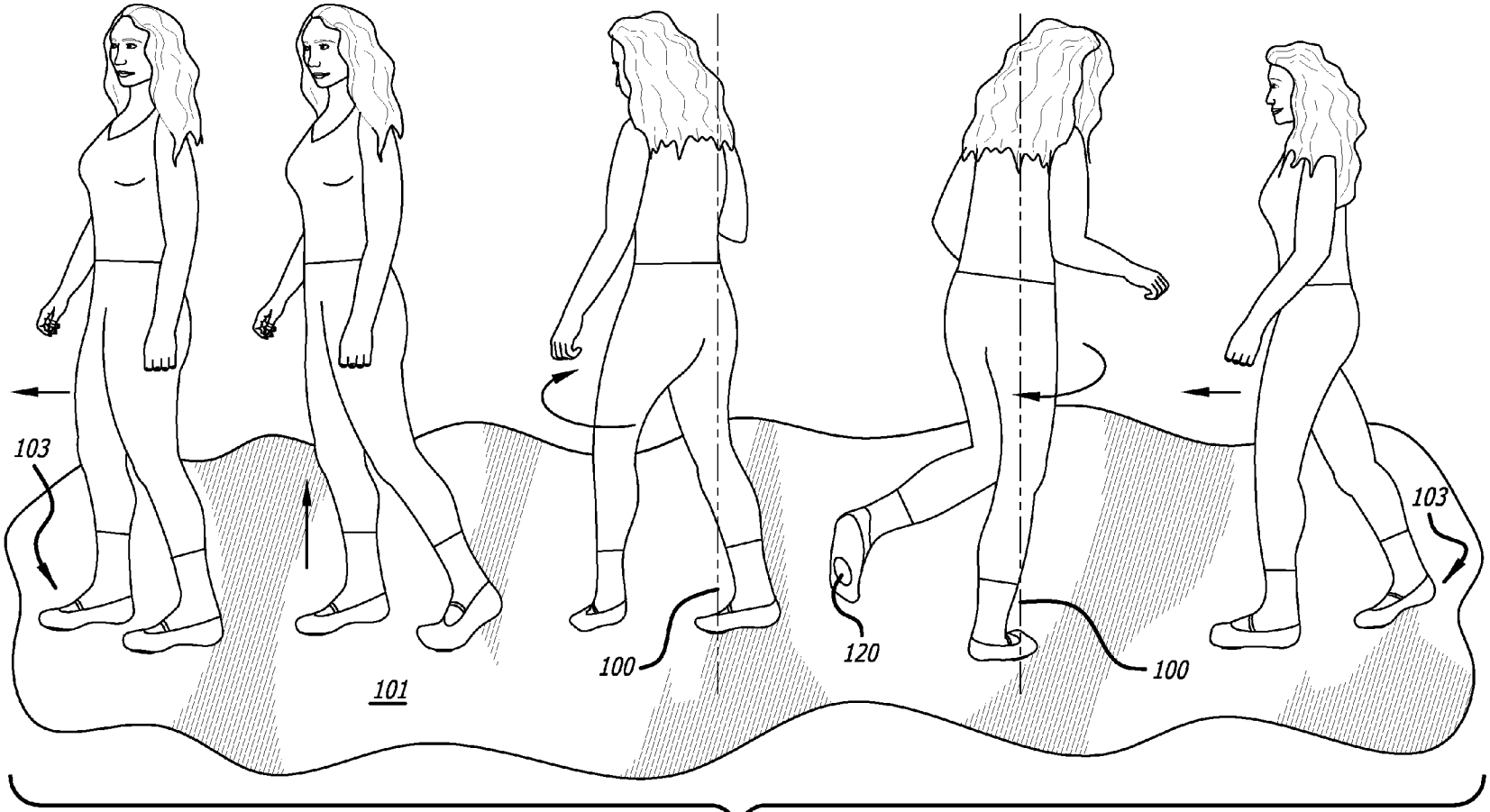
FIG. 5 is a perspective view that illustrates the use of the invention to rotate about a vertical axis.

FIG. 5 is a perspective view that illustrates a user using the present invention. The user is walking and then begins to spin about a vertical axis and then resumes walking.

A user may walk normally on the spinning shoe 103 as the user would in a conventional shoe. When the user so elects to spin along the vertical axis 100, the user may place weight and pressure on the forefoot region, specifically the outsole pad 120, of a single shoe in the invention and then lift up or remove the weight from the opposite shoe and then spin about the vertical axis 100 of the shoe on which the weight is placed. After the user has concluded spinning, the user may enter into a normal stride and walk about.

Figure 6:
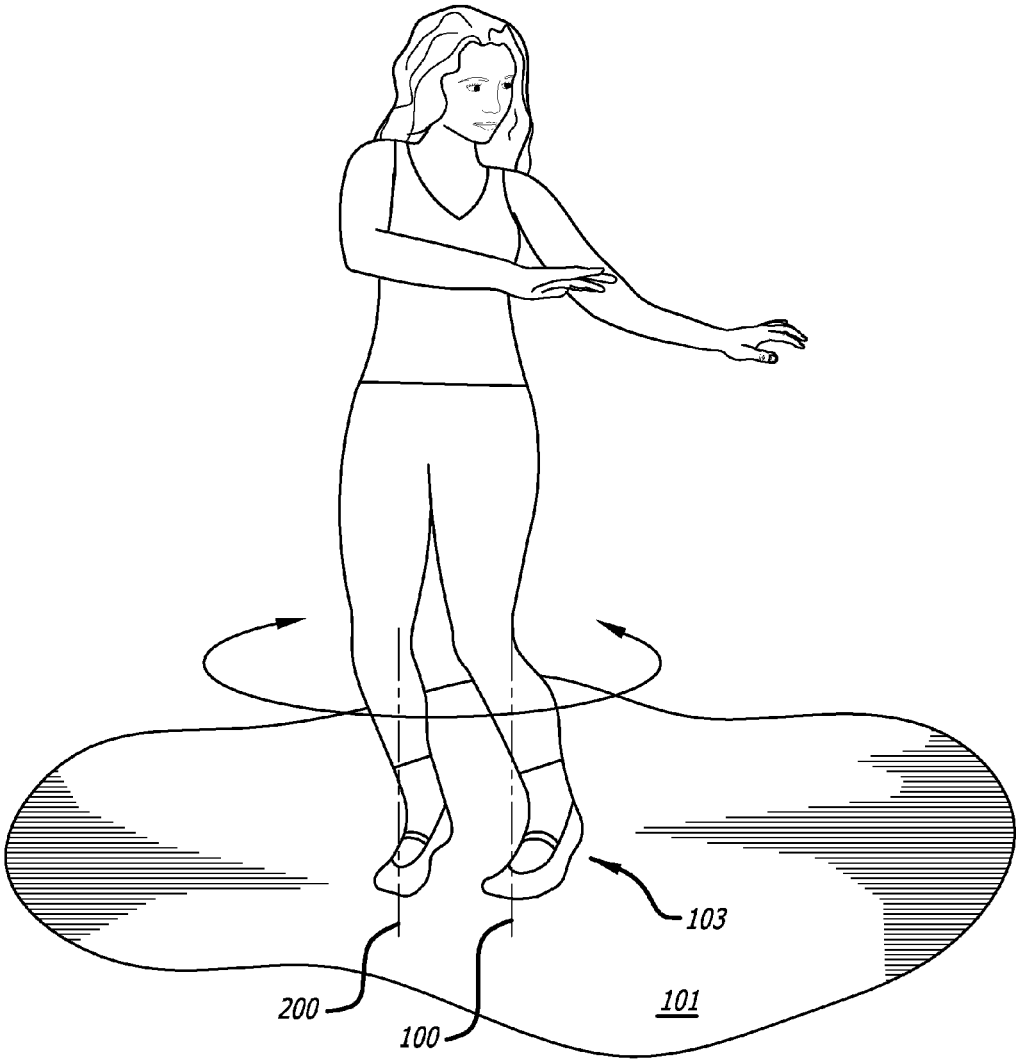
FIG. 6 is a perspective view that illustrates the use of the invention to twist about a vertical axis.

FIG. 6 is a perspective view that illustrates a user using the present invention. The user can place the weight and pressure on the forefoot area of both feet. Then, the user can lift the heel and spin each leg about each vertical axis 100 and 200 of each shoe.

Figure 7:
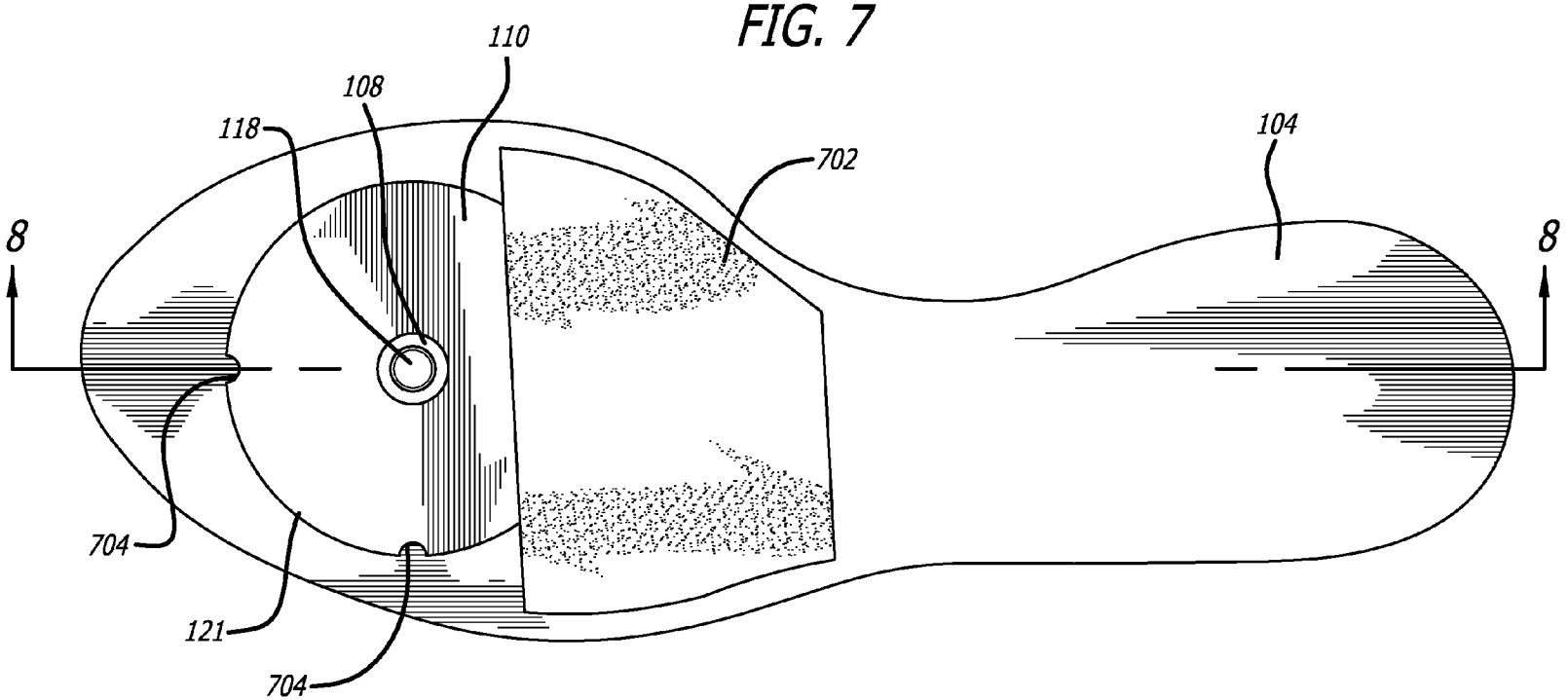
FIG. 7 is a top plan view of an embodiment of the invention.

FIG. 7 is a top plan view of an embodiment of the invention that illustrates a sole pad 702 placed on the top surface of the sole member 104 at a location in the vicinity of the middle region of the sole member 104 towards the toe region. The sole pad 702 overlaps a portion of the recess 106 in which the spinning assembly 122 is placed. The sole pad 702 protects and cushions the user's foot from the rigidity of the spinning assembly 122 and allows for a more smooth transition from the middle region to the toe region during walking, thereby increasing comfort. The sole pad 702 may be constructed from ethylene-vinyl acetate, thermoplastic polyurethane or any other soft, resilient and flexible material.

FIG. 7 also illustrates the multiple notches 704 on the flange 121 of the spinner housing 110. The notches 704 allow the spinner housing 110 to line up properly during production as well as hold the spinner housing 110 in place and prevent it from rotating. Although the preferred embodiment has multiple notches 704, the invention may be constructed with only one notch 704 to hold the spinner housing 110 in place with the sole member 104.

Figure 8:
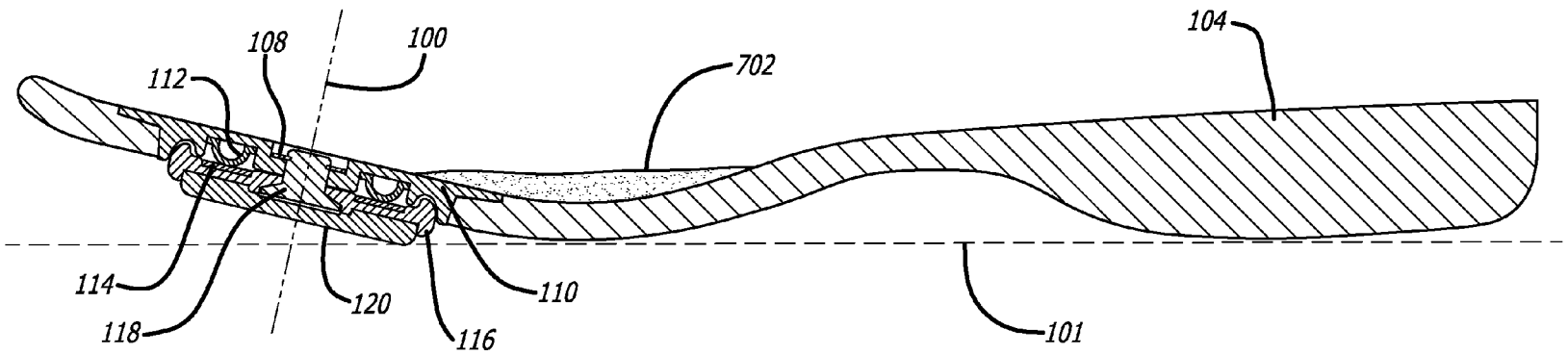
FIG. 8 is a cross-section of an embodiment of the invention along line 8-8.

FIG. 8 is a cross-section view of a preferred embodiment of the invention along line 8-8. It shows the placement of the sole pad 702 and the spinning assembly 122 in the forefoot region of the sole member 104.

While the foregoing detailed description sets forth selected embodiments of a spinning shoe device in accordance with the present invention, the above description is illustrative only and not limiting of the disclosed invention. The claims that follow herein collectively cover the foregoing embodiments. The following claims further encompass additional embodiments that are within the scope and spirit of the present invention.

What is claimed is:

1. A spinning shoe having an upper, a sole member, wherein said sole member has a forefoot region, a middle region and a top surface, a spinning assembly positioned within a recess of said sole member, a sole pad fixedly attached to the top surface of said sole member, said spinning assembly comprising:

an outsole pad for contacting a ground surface;

a spinner lid positioned against said outsole pad to rotate in unison with said outsole pad;

an axle extending through a center hole of said spinner lid;

a spinner housing in which said outsole pad and said spinner lid are positioned with said axle extending rotatably through a center hole of said spinner housing; and said spinner housing has at least one notch in order to position and maintain said spinner housing stationary in said sole member.

2. The spinning shoe of claim 1 wherein said recess is in the forefoot region.

3. The spinning shoe of claim 1 wherein said sole pad is positioned in an area in the middle region of said sole member.

4. The spinning shoe of claim 1 wherein said sole pad is positioned to overlap a portion of the recess in which the spinning assembly is positioned.

5. The spinning shoe of claim 1, further comprising:

a spacer positioned and maintained stationary with respect to said spinner lid by friction, said spacer positioned on the side of said spinner lid opposite a side facing said outsole pad, with said axle extending rotatably through a center hole of said spacer.

6. The spinning shoe of claim 5, further comprising:

a washer positioned against said spacer on a side opposite the side facing said spinner lid and maintained in place by friction, with said axle extending rotatably through a center hole of said washer.

7. The spinning shoe of claim 6, further comprising:

a retaining clip positioned against said spinner housing opposite the side facing said washer in order to secure said axle to thereby hold said spinner lid, said spacer, said washer and said spinner housing together about said axle.

8. The spinning shoe of claim 7 in which the spacer and washer are made of aluminum.

9. The spinning shoe of claim 7 in which the spacer and washer are made of a rigid non-stick material.

10. The spinning shoe of claim 7 in which the washer is a C washer.

11. A method for use of the spinning shoe of claim 1 by a user, the method comprising:

walking on a ground surface while wearing the spinning shoe;

positioning the forefoot region of the spinning shoe on the ground surface;

placing the user's weight on the spinning assembly;

and spinning about the forefoot region of the spinning shoe.

12. A method for use of the spinning shoe of claim 1 by a user, the method comprising:

positioning the forefoot region of a left spinning shoe and a right spinning on the ground surface;

placing the user's weight on the spinning assembly of the left spinning shoe and the right spinning shoe;

and twisting about the forefoot region of the spinning shoes.

13. A spinning shoe having an upper, a sole member, wherein said sole member has a forefoot region, a middle region and a top surface, a spinning assembly positioned within a recess in the forefoot region of said sole member, a sole pad fixedly attached to the top surface of said sole member overlapping a portion of said recess, said spinning assembly comprising:

an outsole pad for contacting a ground surface;

a spinner lid positioned against said outsole pad to rotate in unison with said outsole pad;

an axle extending through a center hole of said spinner lid;

a spacer positioned and maintained stationary with respect to said spinner lid by friction, said spacer positioned on the side of said spinner lid opposite a side facing said outsole pad, with said axle extending rotatably through a center hole of said spacer;

a washer positioned against said spacer on a side opposite the side facing said spinner lid and maintained in place by friction, with said axle extending rotatably through a center hole of said washer;

a spinner housing in which said outsole pad, said spinner lid, said spacer, and said washer are positioned with said axle extending rotatably through a center hole of said spinner housing; and a retaining clip positioned against said spinner housing opposite the side facing said washer in order to secure said axle to thereby hold said spinner lid, said spacer, said washer and said spinner housing together about said axle.

14. The spinning shoe of claim 13 in which the washer is a C washer.

15. The spinning shoe of claim 13 in which the spacer and washer are made of aluminum.

16. The spinning shoe of claim 13 in which the spacer and washer are made of a rigid non-stick material.

17. A method for use of the spinning shoe of claim 13 by a user, the method comprising:

walking on a ground surface while wearing the spinning shoe;

positioning the forefoot region of the spinning shoe on the ground surface;

placing the user's weight on the spinning assembly;

and spinning about the forefoot region of the spinning shoe.

18. A method for use of the spinning shoe of claim 13 by a user, the method comprising:

positioning the forefoot region of a left spinning shoe and a right spinning on the ground surface;

placing the user's weight on the spinning assembly of the left spinning shoe and the right spinning shoe;

and twisting about the forefoot region of the spinning shoes.

19. A spinning shoe having an upper, a sole member, wherein said sole member has a forefoot region, a middle region and a top surface, a spinning assembly positioned within a recess of said sole member, a sole pad positioned above the top surface of said sole member, said spinning assembly comprising:

an outsole pad for contacting a ground surface;

a spinner lid positioned against said outsole pad to rotate in unison with said outsole pad;

an axle extending through a center hole of said spinner lid;

a spacer positioned and maintained stationary with respect to said spinner lid by friction, said spacer positioned on the side of said spinner lid opposite a side facing said outsole pad, with said axle extending rotatably through a center hole of said spacer; and a washer positioned against said spacer on a side opposite the side facing said spinner lid and maintained in place by friction, with said axle extending rotatably through a center hole of said washer; and a spinner housing in which, said outsole pad, said spinner lid, said spacer, and said washer are positioned with said axle extending rotatably through a center hole of said spinner housing.

20. The spinning shoe of claim 19 in which the spacer and washer are made of aluminum.

21. The spinning shoe of claim 19 in which the spacer and washer are made of a rigid non-stick material.

22. The spinning shoe of claim 19 in which the washer is a C washer.

23. The spinning shoe of claim 19 in which the assembly is placed in the said forefoot region or the said middle region of the sole member.

24. A method for use of the spinning shoe of claim 19 by a user, the method comprising:

walking on a ground surface while wearing the spinning shoe;

positioning the forefoot region of the spinning shoe on the ground surface;

placing the user's weight, on the spinning assembly;

and spinning about the forefoot region of the spinning shoe.

25. A method for use of the spinning shoe of claim 19 by a user, the method comprising:

positioning the forefoot region of a left spinning shoe and a right spinning on the ground surface;

placing the user's weight on the spinning assembly of the left spinning shoe and the right spinning shoe;

and twisting about the forefoot region of the spinning shoes.

* * * * *

UNITED STATES PATENT AND TRADEMARK OFFICE

CERTIFICATE OF CORRECTION

PATENT NO. : 8,341,855 B2
APPLICATION NO. : 13/075075
DATED : January 1, 2013
INVENTOR(S) : Savva Teteriatnikov It is certified that error appears in the above-identified patent and that said Letters Patent is hereby corrected as shown below:

In the Claims:

In Claim 23, column 8, line 18, before “assembly”, insert --spinning--.

In Claim 24, column 8, line 27, before “on the spinning assembly”, delete “,”.

Signed and Sealed this
Twenty-third Day of April, 2013

Teresa Stanek Rea
*Acting Director of the United States Patent and Trademark Office*